US009275567B2

(12) United States Patent
Kang

(10) Patent No.: US 9,275,567 B2
(45) Date of Patent: Mar. 1, 2016

(54) PIXEL AND ORGANIC LIGHT EMITTING DISPLAY USING THE SAME

(75) Inventor: Chul-Kyu Kang, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 808 days.

(21) Appl. No.: 13/137,899

(22) Filed: Sep. 21, 2011

(65) Prior Publication Data

US 2012/0113077 A1 May 10, 2012

(30) Foreign Application Priority Data

Nov. 5, 2010 (KR) ..... 10-2010-0109850

(51) Int. Cl.

*G09G 5/00* (2006.01)
*G09G 3/00* (2006.01)
*G09G 3/32* (2006.01)

(52) U.S. Cl.

CPC ..... *G09G 3/003* (2013.01); *G09G 3/3233* (2013.01); *G09G 2300/0852* (2013.01); *G09G 2300/0861* (2013.01)

(58) Field of Classification Search

CPC ..... G09G 2300/0852; G09G 2300/0861; G09G 3/003; G09G 3/3233
USPC ..... 345/211–213, 204, 419, 76, 691, 80
See application file for complete search history.

(56) References Cited

U.S. PATENT DOCUMENTS

2004/0263060 A1* 12/2004 Gilmour et al. ..... 313/501
2005/0269958 A1* 12/2005 Choi et al. ..... 315/169.3
2006/0097966 A1* 5/2006 Choi ..... 345/77
2006/0114193 A1 6/2006 Kwak et al.
2006/0132053 A1 6/2006 Cho et al.
2007/0063993 A1* 3/2007 Shishido ..... 345/175
2008/0158114 A1 7/2008 Kim
2008/0211397 A1* 9/2008 Choi ..... 313/504
2009/0167648 A1* 7/2009 Jeon et al. ..... 345/76
2009/0309816 A1* 12/2009 Choi ..... G09G 3/3233 345/76
2010/0201656 A1* 8/2010 Han et al. ..... 345/205
2010/0220040 A1* 9/2010 Kwak ..... G09G 3/3233 345/76
2010/0245219 A1* 9/2010 Shishido ..... 345/80
2010/0245402 A1* 9/2010 Choi ..... G09G 3/3233 345/690

FOREIGN PATENT DOCUMENTS

JP 2008-165166 A 7/2008
JP 2008-249744 A 10/2008
KR 10-2006-0056791 A 5/2006

(Continued)

OTHER PUBLICATIONS

Japanese Office Action dated Dec. 24, 2014.

*Primary Examiner* — Quan-Zhen Wang
*Assistant Examiner* — Tony Davis
(74) *Attorney, Agent, or Firm* — Lee & Morse, P.C.

(57) ABSTRACT

A pixel may include an organic light emitting diode (OLED) with a cathode electrode coupled to a second power source, a first transistor with a first electrode coupled to a data line, with a second electrode coupled to a first node, the first transistor being turned on when a scan signal is supplied to a scan line, a first capacitor coupled between the first node and a third power source to charge a first capacitor voltage corresponding to a data signal supplied from the data line, and a pixel circuit charged by the first capacitor voltage to supply current corresponding to a charged first power source voltage from a first power source to the second power source via the OLED.

19 Claims, 8 Drawing Sheets

(56) References Cited

FOREIGN PATENT DOCUMENTS

| | | | |
|---|---|---|---|
| KR | 10-2006-0068538 | A | 6/2006 |
| KR | 10-2007-0083072 | A | 8/2007 |
| KR | 10 2008-0026278 | A | 3/2008 |
| KR | 10 2010-0033061 | A | 3/2010 |

* cited by examiner

PIXEL AND ORGANIC LIGHT EMITTING DISPLAY USING THE SAME

CROSS-REFERENCE TO RELATED APPLICATION

This application claims priority to and the benefit of Korean Patent Application No. 10-2010-0109850, filed on Nov. 5, 2010, in the Korean Intellectual Property Office, the entire content of which is incorporated herein by reference.

BACKGROUND

1. Field

Embodiments relate to a pixel capable of being driven at a low driving frequency and an organic light emitting display using the same.

2. Description of the Related Art

Recently, various flat panel displays (FPD) capable of reducing weight and volume have been developed. Weight and volume are disadvantages of cathode ray tubes (CRT). The FPDs include liquid crystal displays (LCD), field emission displays (FED), plasma display panels (PDP), and organic light emitting displays.

The organic light emitting displays display images using organic light emitting diodes (OLED) that generate light by re-combination of electrons and holes. The organic light emitting display has high response speed and is driven with low power consumption.

The organic light emitting display includes a plurality of data lines, scan lines, and a plurality of pixels arranged in a matrix at intersections of power lines. Each pixel includes an organic light emitting diode, at least two transistors including a drive transistor, and at least one capacitor.

The organic light emitting display includes four frames in a period of 16.6 ms as illustrated in FIG. 1 in order to realize a 3D image. Among the four frames, a first frame displays a left image and a third frame displays a right image. A second frame and a fourth frame display a black image.

SUMMARY

Embodiments are directed to a pixel and an organic light emitting display using the same.

An embodiment may include a pixel, including an organic light emitting diode (OLED) with a cathode electrode coupled to a second power source, a first transistor with a first electrode coupled to a data line, with a second electrode coupled to a first node, the first transistor being turned on when a scan signal is supplied to a scan line, a first capacitor coupled between the first node and a third power source to charge a first capacitor voltage corresponding to a data signal supplied from the data line, and a pixel circuit charged by the first capacitor voltage, the pixel circuit controls current from a first power source to the second power source via the OLED.

Another embodiment may include pixels positioned at intersections of scan lines and data lines, a scan driver for sequentially supplying scan signals to the scan lines, a data driver for supplying data signals to the data lines in synchronization with the scan signals, a first control line and a second control line commonly coupled to the pixels, and a control driver for sequentially supplying a first control signal to the first control line and a second control signal to the second control line in a stage before the scan signals are supplied to the scan lines in frames. Among the pixels, a pixel positioned in a jth horizontal line includes a first capacitor for charging a data signal voltage corresponding to the data signal when, among the scan signals, a scan signal is supplied to a jth scan line and a second capacitor for charging a first capacitor voltage corresponding to the voltage charged in the first capacitor when the second control signal is supplied to the second control line.

BRIEF DESCRIPTION OF THE DRAWINGS

The above and other features will become more apparent to those of ordinary skill in the art by describing in detail exemplary embodiments with reference to the attached drawings, in which.

DETAILED DESCRIPTION

Korean Patent Application No. 10-2010-0109850, filed on Nov. 5, 2010, in the Korean Intellectual Property Office, and entitled: "Pixel and Organic Light Emitting Display Device" is incorporated by reference herein in its entirety.

Example embodiments will now be described more fully hereinafter with reference to the accompanying drawings; however, they may be embodied in different forms and should not be construed as limited to the embodiments set forth herein.

Hereinafter, exemplary embodiments, by which those who skilled in the art may easily perform, will be described in detail with reference to FIGS. 2 to 9.

Figure 1:
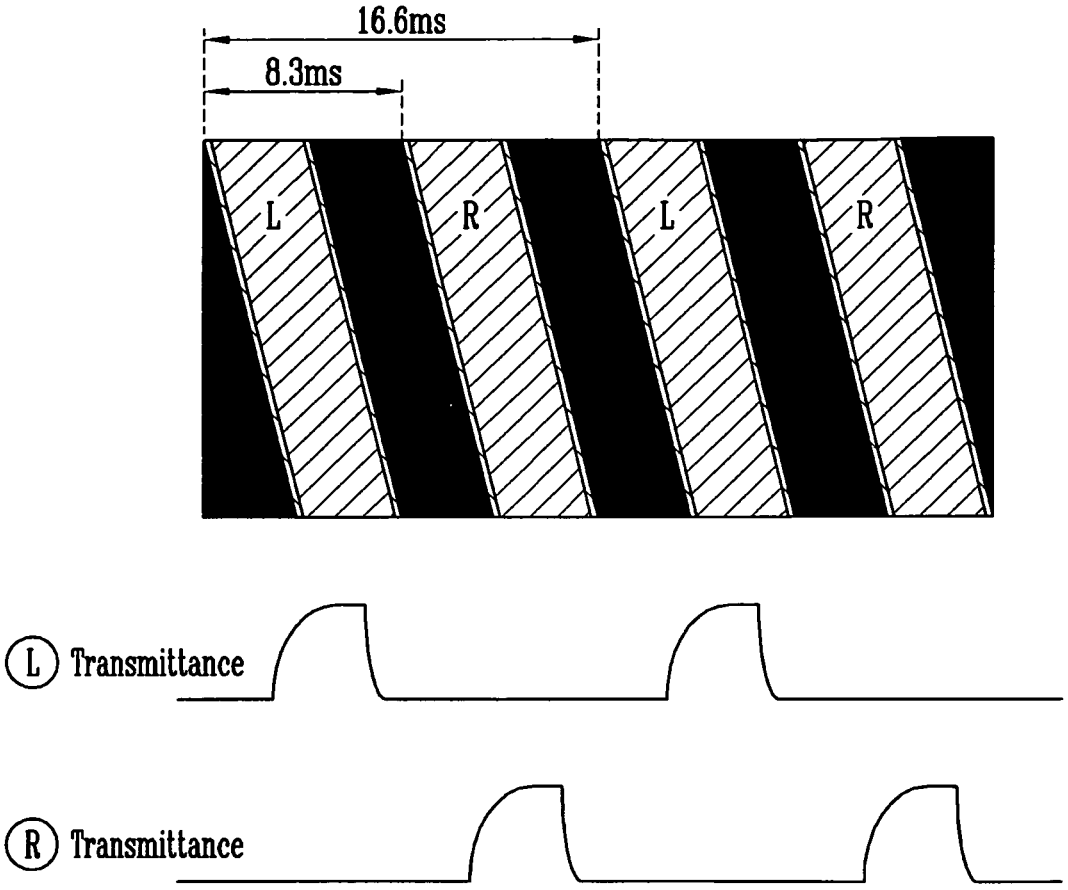
FIG. 1 illustrates frames for 3D driving.
Figure 2:
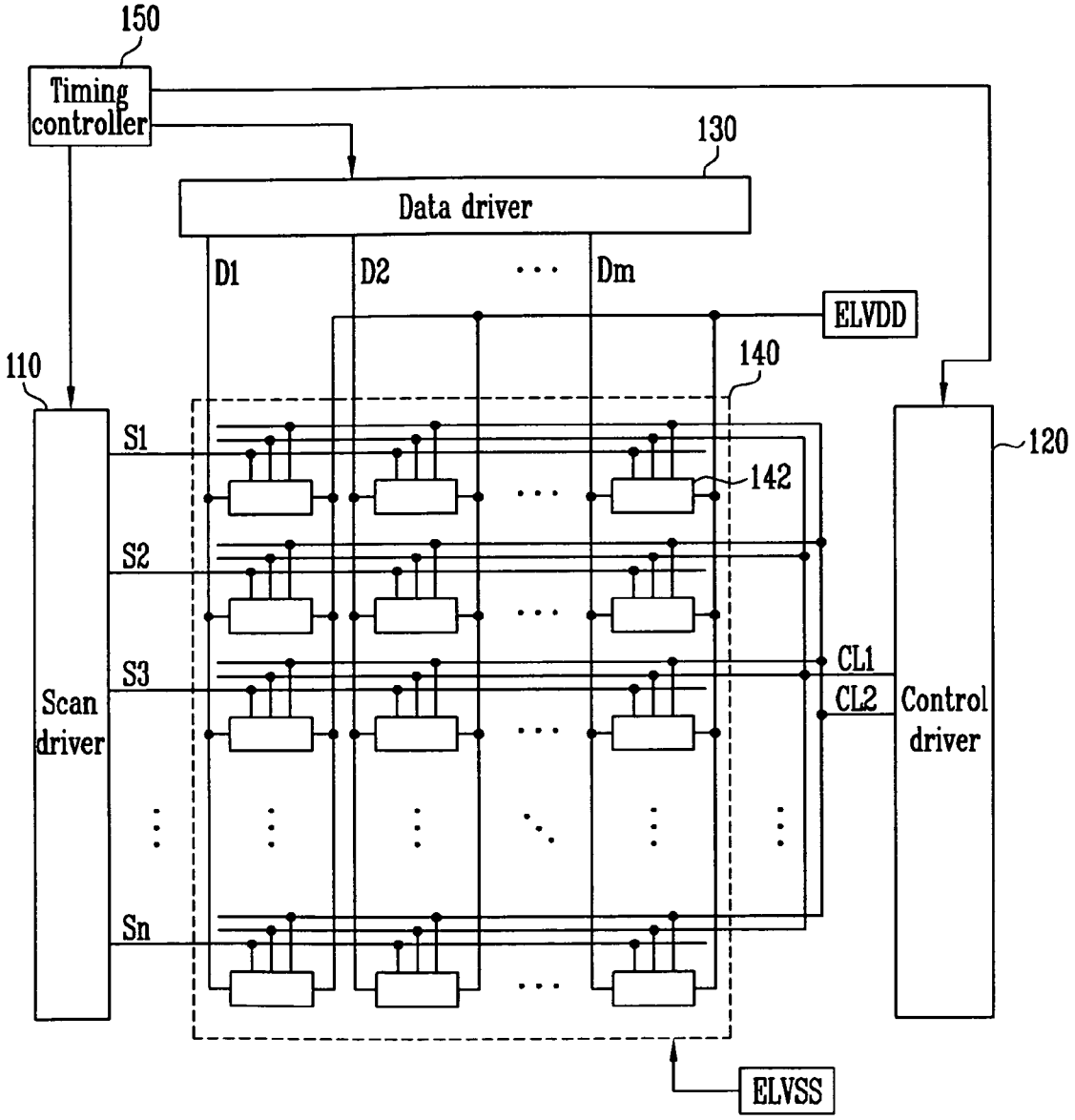
FIG. 2 illustrates a view of an organic light emitting display according to a first embodiment.

FIG. 2 is a view illustrating an organic light emitting display according to a first embodiment.

Referring to FIG. 2, the organic light emitting display according to the first embodiment includes a pixel unit 140 including pixels 142 positioned at the intersections of scan lines S1 to Sn, first control lines CL1, second control lines CL2, and data lines D1 to Dm, a scan driver 110 for driving the scan lines S1 to Sn, a control driver 120 for driving the first control lines CL1 and the second control lines CL2, a data driver 130 for driving the data lines D1 to Dm, and a timing controller 150 for controlling the drivers 110, 120, and 130.

The scan driver 110 sequentially supplies scan signals to the scan lines S1 to Sn every frame. When the scan signals are supplied to the scan lines S1 to Sn, the pixels 142 are selected in units of horizontal lines.

The data driver 130 supplies data signals to the data lines D1 to Dm in synchronization with the scan signals. Then, the data signals are supplied to the pixels 142 selected by the scan signals. The data driver 130 alternately supplies left data signals and right data signals every frame. For example, the data driver 130 supplies the right data signals in ith (i is a natural number) frames iF and supplies the left data signals in (i+1)th frames i+1F. The right data signals mean the signals corresponding to the right side of the shutter glasses and the left data signals mean the signals corresponding to the left side of the shutter glasses.

The control driver 120 supplies a first control signal and a second control signal to the first control lines CL1 and the second control lines CL2 commonly coupled to the pixels 142. The first control signal and the second control signal are supplied at the early stage of each of the frames, i.e., before the scan signals are supplied to the scan lines S1 to Sn.

The pixels 142 are positioned at the intersections of the scan lines S1 to Sn, the first control lines CL1, the second control lines CL2, and the data lines D1 to Dm. The pixels 142 charge the right data signals to correspond to the scan signals supplied to the scan lines S1 to Sn in the ith frames. The pixels 142 simultaneously emit light components corresponding to the left data signals in the ith frames where the right data signals are charged. In addition, the pixels 142 charge the left data signals to correspond to the scan signals supplied to the scan lines S1 to Sn in the (i+1)th frames. The pixels 142 simultaneously emit light components corresponding to the right data signals in the (i+1)th frames where the left data signals are charged.

Figure 3A:
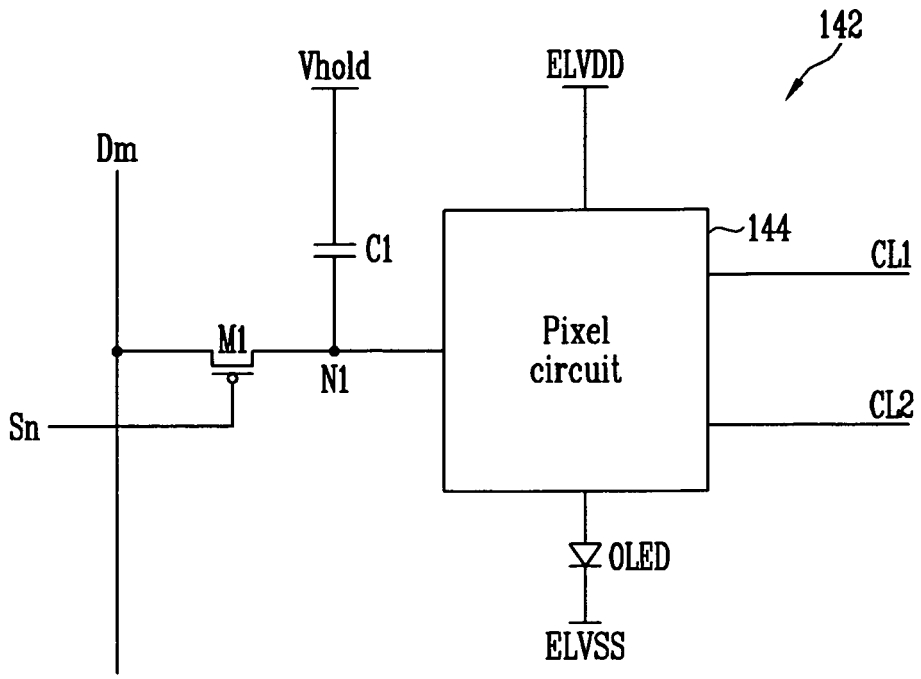
FIGS. 3A and 3B illustrate views of an embodiment of a pixel of FIG. 2.
Figure 3B:
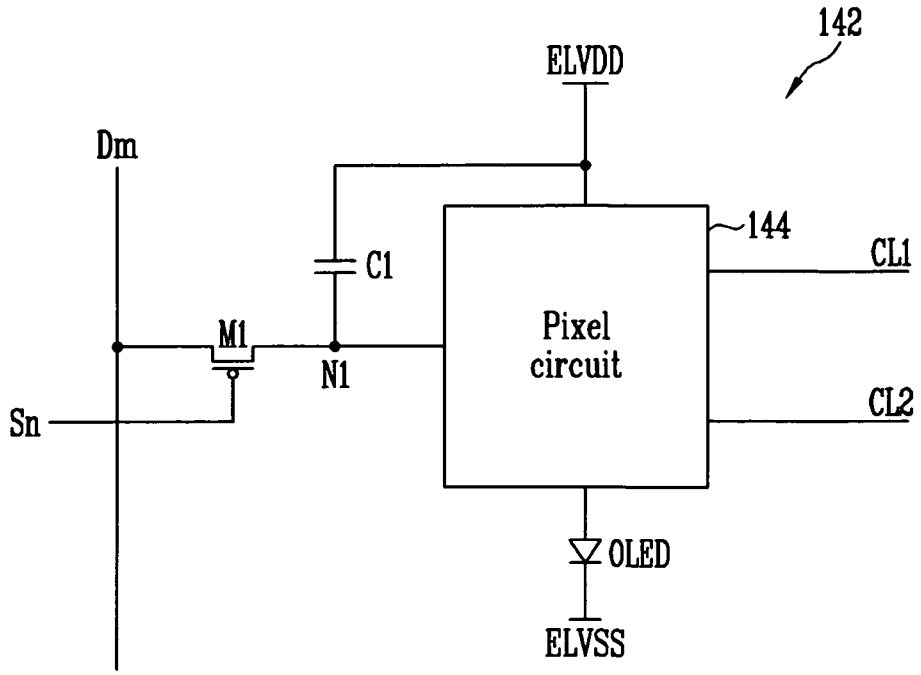

FIGS. 3A and 3B are views illustrating an embodiment of the pixel of FIG. 2. In FIGS. 3A and 3B, the pixel coupled to the mth data line Dm and the nth scan line Sn will be illustrated.

Referring to FIG. 3A, the pixel 142 according to the embodiment includes a first transistor M1, a first capacitor C1, a pixel circuit 144, and an organic light emitting diode (OLED).

The anode electrode of the OLED is coupled to the pixel circuit 144 and the cathode electrode of the OLED is coupled to a second power source ELVSS. The OLED generates light with predetermined brightness to correspond to the amount of current supplied from the pixel circuit 144.

The first electrode of the first transistor M1 is coupled to the data line Dm and the second electrode of the first transistor M1 is coupled to a first node N1 coupled to the pixel circuit 144. Then, the gate electrode of the first transistor M1 is coupled to the scan line Sn. The first transistor M1 is turned on when a scan signal is supplied to the scan line Sn.

The first capacitor C1 is coupled between the first node N1 and a third power source Vhold. The first capacitor C1 charges the voltage corresponding to the data signal supplied from the data line Dm when the first transistor M1 is turned on. The third power source Vhold may be set as a fixed power source (i.e., a direct current power source) at a predetermined voltage.

The third power source Vhold is set to have the same voltage as a first power source ELVDD and may be coupled to the first capacitor C1 through an additional line. In addition, the third power source Vhold may be selected as the first power source ELVDD as illustrated in FIG. 3B and may be selected as one of the various types of power sources (i.e., the initial power source Vint of FIG. 4) supplied to the pixel. For convenience, it is assumed that the third power source Vhold is selected as the first power source ELVDD.

The pixel circuit 144 is initialized when the first control signal is supplied to the first control lines CL1 and charges a predetermined voltage to correspond to the voltage charged in the first capacitor C1 when the second control signal is supplied to the second control lines CL2. The pixel circuit 144 that charges a predetermined voltage controls the amount of current supplied to the OLED to correspond to the voltage charged therein. The pixel circuit 144 may be realized by well-known types of various circuits.

Figure 4:
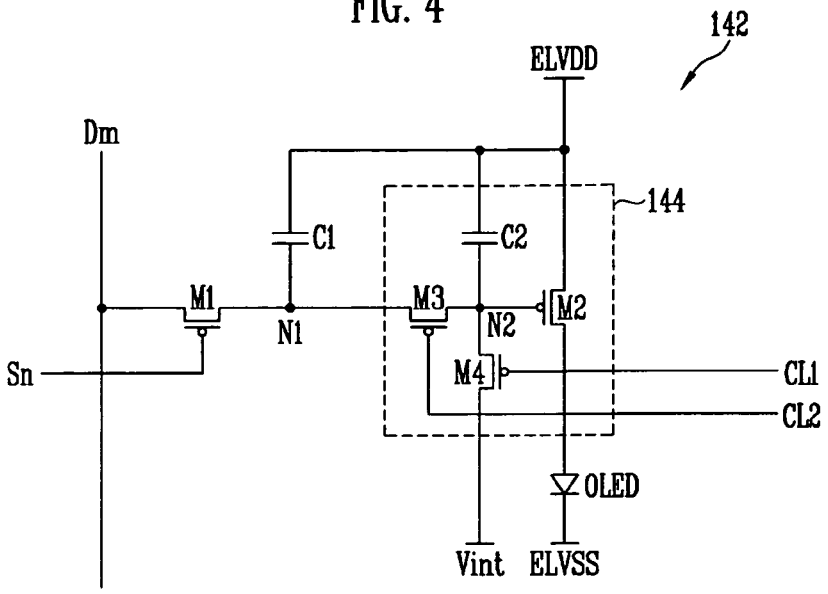
FIG. 4 illustrates a view of an embodiment of the pixel circuit of FIGS. 3A and 3B.

FIG. 4 is a view illustrating an embodiment of the pixel circuit of FIG. 3.

Referring to FIG. 4, the pixel circuit 144 includes a second transistor M2, a third transistor M3, a fourth transistor M4, and a second capacitor C2.

The first electrode of the second transistor M2 is coupled to the first power source ELVDD, the second electrode of the second transistor M2 is coupled to the anode electrode of the OLED, and the gate electrode of the second transistor M2 is coupled to a second node N2. The second transistor M2 supplies the current corresponding to the voltage applied to the second node N2 from the first power source ELVDD to the second power source ELVSS via the OLED.

The first electrode of the third transistor M3 is coupled to the first node N1 and the second electrode of the third transistor M3 is coupled to the second node N2. Then, the gate electrode of the third transistor M3 is coupled to the second control line CL2. The third transistor M3 is turned on when the second control signal is supplied to the second control line CL2 to electrically couple the first node N1 to the second node N2.

The first electrode of the fourth transistor M4 is coupled to the second node N2 and the second electrode of the fourth transistor M4 is coupled to the initial power source Vint. Then, the gate electrode of the fourth transistor M4 is coupled to the first control line CL1. The fourth transistor M4 is turned on when the first control signal is supplied to the first control line CL1 to supply the voltage of the initial power source Vint to the second node N2. The initial power source Vint is set to have a lower voltage than the data signal so that the second node N2 is initialized by the voltage of the initial power source Vint when the fourth transistor M4 is turned on.

The second capacitor C2 is coupled between the second node N2 and the first power source ELVDD. The second capacitor C2 is charged to correspond to the voltage supplied from the first capacitor C1 when the third transistor M3 is turned on.

Figure 5:
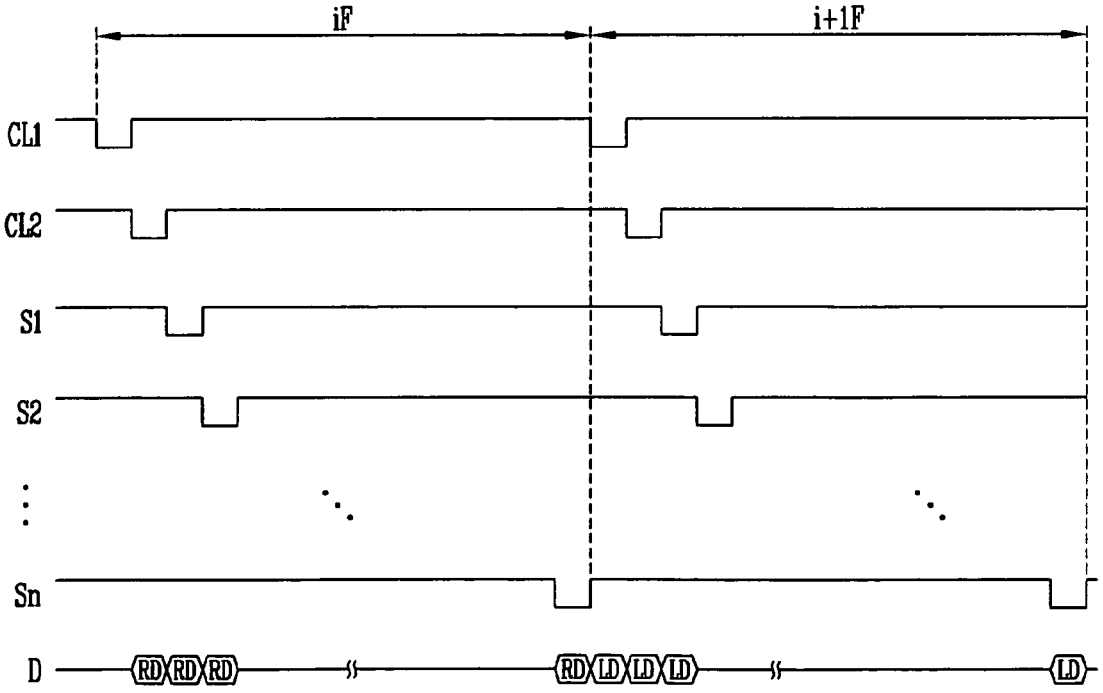
FIG. 5 illustrates a waveform chart of a method of driving the pixel of FIG. 4.
Figure 6:
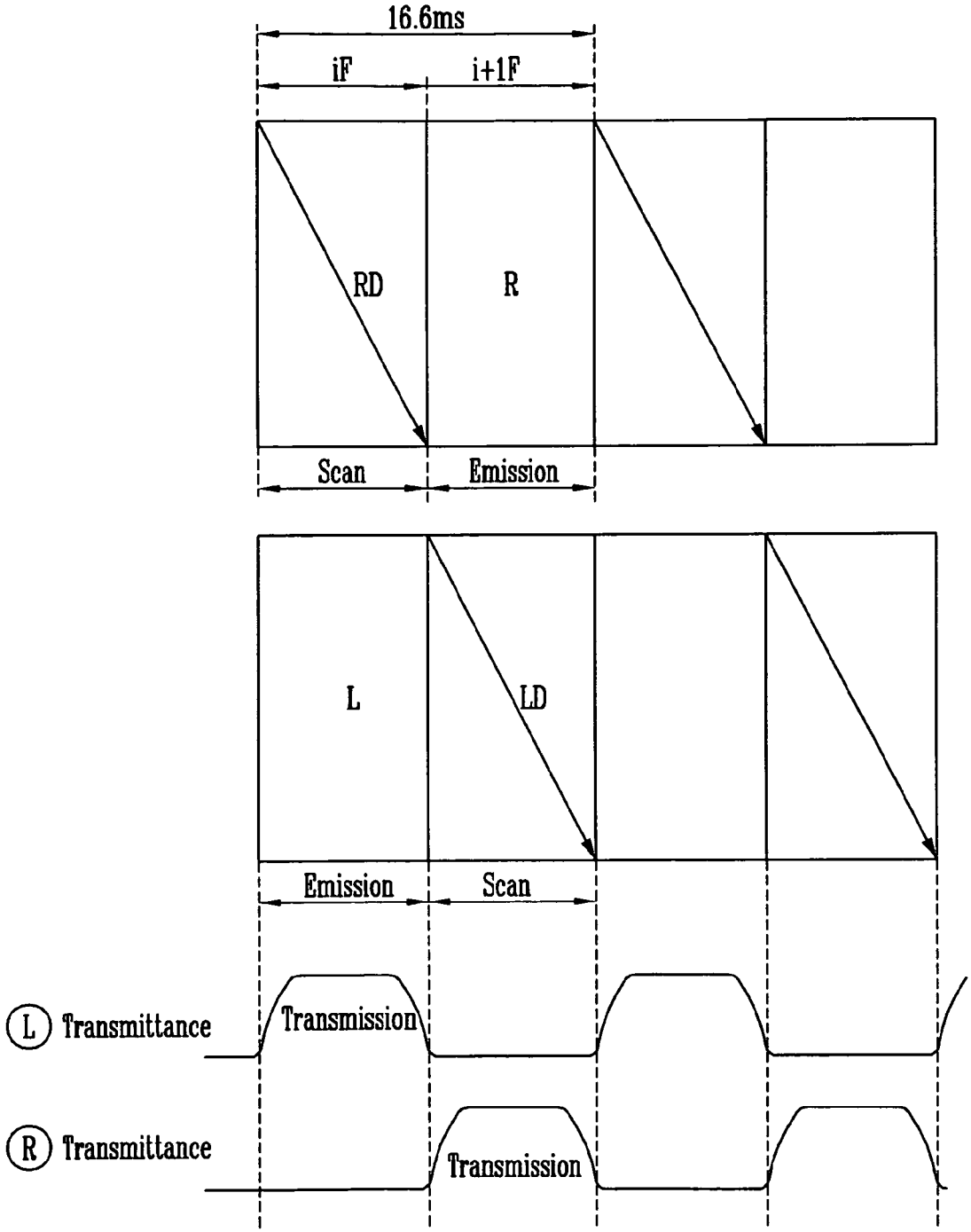
FIG. 6 illustrates a view of frames according to present embodiments for 3D driving.

FIG. 5 is a waveform chart illustrating a method of driving the pixel of FIG. 4. FIG. 6 is a view illustrating frames according to present embodiments for 3D driving.

Referring to FIGS. 5 and 6, the first control signal is supplied to the first control line CL1 at the early stage of the ith frame iF. When the first control signal is supplied, the fourth transistor M4 is turned on so that the voltage of the initial power source Vint is supplied to the second node N2. When the first control signal is supplied to the first control line CL1, the second node N2 of each of the pixels 142 is set to have the voltage of the initial power source Vint. When the second node N2 of each of the pixels 142 is set to have the voltage of the initial power source Vint before the data signal is supplied, an image with uniform brightness may be displayed.

After the voltage of the initial power source Vint is supplied to the second node N2, the second control signal is supplied to the second control line CL2 so that the third transistor M3 is turned on. When the third transistor M3 is turned on, the voltage corresponding to the left data signal LD charged in the first capacitor C1 in an (i−1)th frame i−1F is supplied to the second node so that the second capacitor C2 charges the voltage corresponding to the left data signal LD.

The voltage charged in the second capacitor C2 is determined by the coupling of the first capacitor C1 and the second capacitor C2. Therefore, only the partial voltage charged in the first capacitor C1 is charged in the second capacitor C2 so that an image with desired brightness may not be displayed. Therefore, according to present embodiments, the voltage of the data signal is set considering the coupling of the first capacitor C1 and the second capacitor C2. Then, a higher voltage than a desired voltage is charged in the first capacitor C1 and the desired voltage is charged in the second capacitor C2 that receives the voltage from the first capacitor C1. In addition, according to present embodiments, the first capacitor C1 has a larger capacity than the second capacitor C2 so that the voltage may be stably charged in the second capacitor C2.

After a predetermined voltage is charged in the second capacitor C2, the second transistor M2 supplies the current corresponding to the voltage charged in the second capacitor C2 to the OLED. At this time, the OLED generates light with predetermined brightness to correspond to the amount of current supplied thereto. The amount of current supplied to the OLED in the ith frame iF is determined to correspond to the left data signal LD supplied in the (i−1)th frame i−1F.

In the period where the OLED of each of the pixels 142 emits light, scan signals are sequentially supplied to the first scan signal to the nth scan signal Sn. The right data signal RD is supplied to the data lines D1 to Dm in synchronization with the scan signals.

When a scan signal is supplied to the nth scan line Sn, the first transistor M1 is turned on. When the first transistor M1 is turned on, the right data signal RD from the data line Dm is supplied to the first node N1. At this time, the first capacitor C1 charges the voltage corresponding to the right data signal.

The OLED emits light to correspond to the left data signal LD supplied to the (i−1)th frame i−1F in the ith frame iF and the first capacitor C1 charges the voltage corresponding to the right data signal RD supplied in the ith frame iF.

The first control signal is supplied to the first control line CL1 in the (i+1)th frame i+1F so that the second node N2 included in each of the pixels 142 is set to have the voltage of the initial power source Vint. Then, the second control signal is supplied to the second control line CL2 so that the third transistor M3 included in each of the pixels is turned on. When the third transistor M3 is turned on, the second capacitor C2 charges the voltage corresponding to the voltage supplied from the first capacitor C1.

After a predetermined voltage is charged in the second capacitor C2, the second transistor M2 supplies the current corresponding to the voltage charged in the second capacitor C2 to the OLED. At this time, the OLED generates light with predetermined brightness to correspond to the amount of current supplied thereto. The amount of current supplied to the OLED in the (i+1)th frame i+1F is determined to correspond to the right data signal RD supplied in the ith frame iF.

While the scan signals are sequentially supplied to the first scan line S1 to the nth scan line Sn, the first transistor M1 included in each of the pixels 142 is turned on in units of horizontal lines. At this time, the left data signals LD are supplied to the data lines D1 to Dm in synchronization with the scan signals. Therefore, the voltage corresponding to the left data signal LD is charged in the first capacitor C1 included in each of the pixels 142 in the (i+1)th frame i+1F.

As described above, according to present embodiments, the pixels 142 alternately generate light components corresponding to the left and right data signals in the frames. While the pixels 142 generate light components corresponding to the left (or right) data signals, the voltages corresponding to the right (or left) data signals are charged. While the pixels 142 according to present embodiments emit light, the voltages corresponding to the data signals are charged so that the left images and the right images may be alternately generated every frame. In this case, according to present embodiments, as illustrated in FIG. 6, a 3D image may be realized at the driving frequency of 120 Hz.

Figure 7:
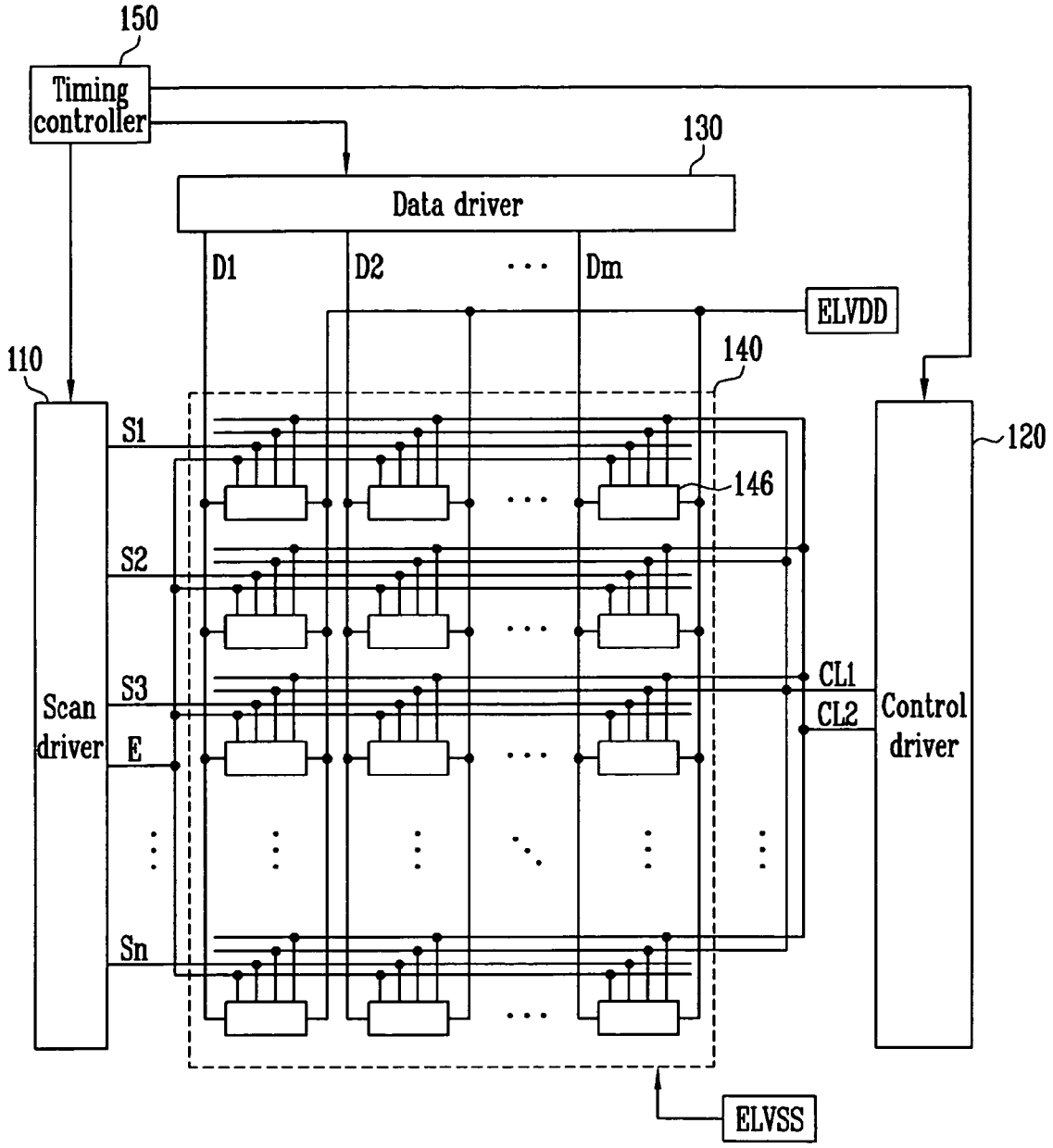
FIG. 7 illustrates a view of an organic light emitting display according to another embodiment.

FIG. 7 is a view illustrating an organic light emitting display according to a second embodiment. When FIG. 7 is described, the same elements as those of FIG. 2 are denoted by the same reference numerals and detailed description thereof will be omitted.

Referring to FIG. 7, the organic light emitting display according to the second embodiment further includes an emission control line E to be commonly coupled to the pixels 146. The emission control line E receives the emission control signal from the scan driver 110 to transmit the emission control signal to the pixels 146.

In the organic light emitting display according to the second embodiment, the emission control line E is added to the circuit structure of the pixels 146 and the other structures are the same those of FIG. 2.

Figure 8:
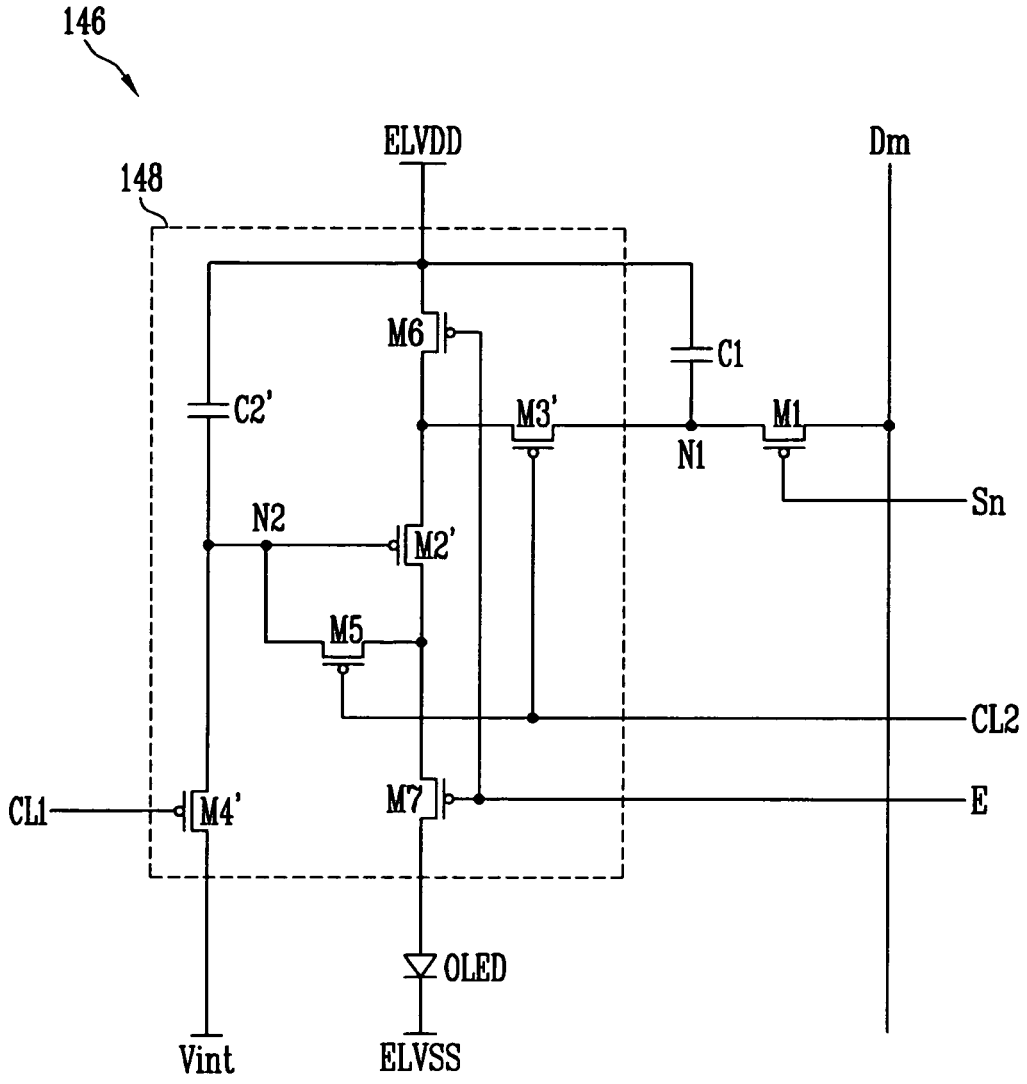
FIG. 8 illustrates a view of an embodiment of the pixel of FIG. 7.

FIG. 8 is a view illustrating an embodiment of the pixel of FIG. 7. When FIG. 8 is described, the same elements as those of FIG. 4 are denoted by the same reference numerals and detailed description thereof will be omitted.

Referring to FIG. 8, a pixel circuit 148 includes second to seventh transistors M2' to M7 and a second capacitor C2'.

The first electrode of the second transistor M2' is coupled to the second electrode of the sixth transistor M6 and the second electrode of the second transistor M2' is coupled to the first electrode of the seventh transistor M7. Then, the gate electrode of the second transistor M2' is coupled to the second node N2. The second transistor M2' supplies the current corresponding to the voltage applied to the second node N2 from the first power source ELVDD to the second power source ELVSS via the OLED.

The first electrode of the third transistor M3' is coupled to the first node N1 and the second electrode of the third transistor M3' is coupled to the first electrode of the second transistor M2'. The gate electrode of the third transistor M3' is coupled to the second control line CL2. The third transistor M3' is turned on when the second control signal is supplied to the second control line CL2 to electrically couple the first node N1 to the first electrode of the second transistor M2'.

The first electrode of the fourth transistor M4' is coupled to the second node N2 and the second electrode of the fourth transistor M4' is coupled to the initial power source Vint. Then, the gate electrode of the fourth transistor M4' is coupled to the first control line CL1. The fourth transistor M4' is turned on when the first control signal is supplied to the first control line CL1 to supply the voltage of the initial power source Vint to the second node N2.

The first electrode of the fifth transistor M5 is coupled to the second electrode of the second transistor M2' and the first electrode of the fifth transistor M5 is coupled to the second node N2. The gate electrode of the fifth transistor M5 is coupled to the second control line CL2. The fifth transistor M5 is turned on when the second control signal is supplied to the second control line CL2 to couple the second transistor M2' in the form of a diode.

The first electrode of the sixth transistor M6 is coupled to the first power source ELVDD and the second electrode of the sixth transistor M6 is coupled to the first electrode of the second transistor M2'. The gate electrode of the sixth transistor M6 is coupled to the emission control line E. The sixth transistor M6 is turned off when the emission control signal is supplied to the emission control line E and is turned on when the emission control signal is not supplied.

The first electrode of the seventh transistor M7 is coupled to the second electrode of the second transistor M2' and the second electrode of the seventh transistor M7 is coupled to the anode electrode of the OLED. The gate electrode of the seventh transistor M7 is coupled to the emission control line E.

The seventh transistor M7 is turned off when the emission control signal is supplied to the emission control line E and is turned on when the emission control signal is not supplied to the emission control line E.

The second capacitor C2' is coupled between the second node N2 and the first power source ELVDD. The second capacitor C2' is charged to correspond to the voltage supplied from the first capacitor c1 when the third transistor M3' and the fifth transistor M5' are turned on.

Figure 9:
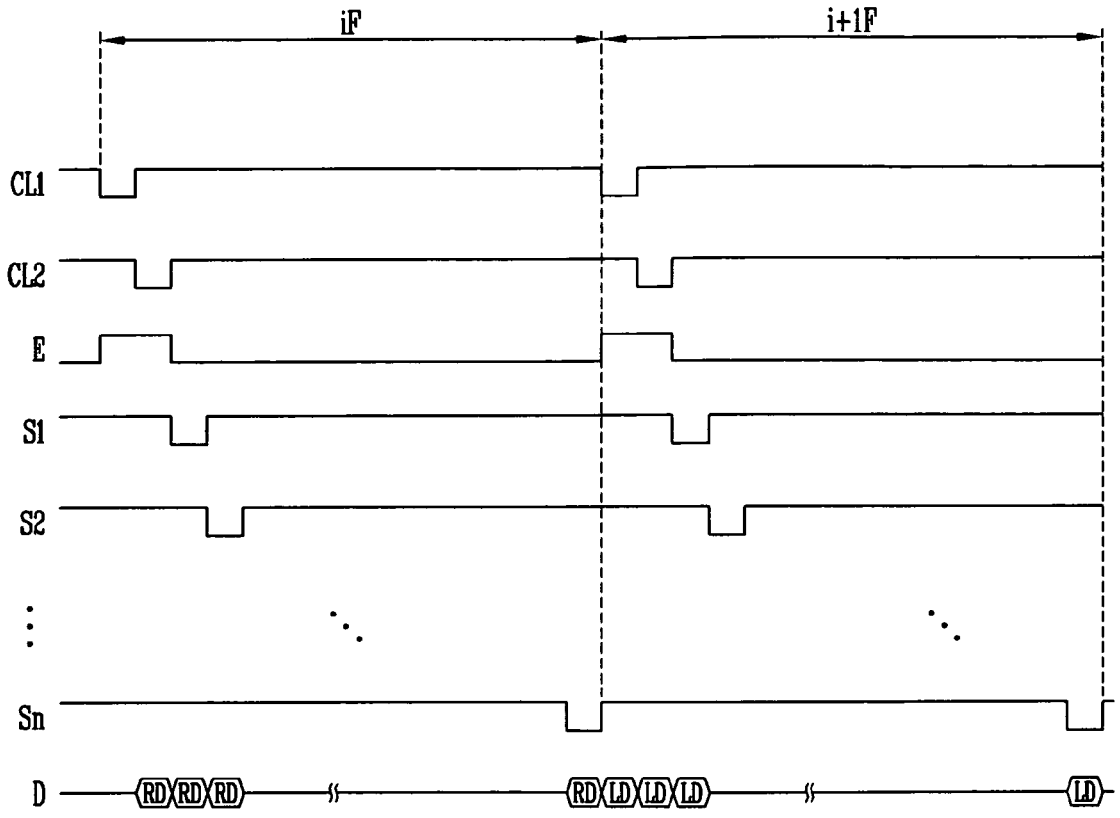
FIG. 9 illustrates a waveform chart of a method of driving the pixel of FIG. 8.

FIG. 9 is a waveform chart illustrating a method of driving the pixel of FIG. 8.

Referring to FIG. 9, the first control signal and the second control signal are sequentially supplied to the first control line CL1 and the second control line CL2 at the early stage of the ith frame iF. Then, the emission control signal is supplied to the emission control line E to overlap the first control signal and the second control signal.

When the emission control signal is supplied to the emission control line E, the sixth transistor M6 and the seventh transistor M7 are turned off. When the sixth transistor M6 is turned off, the first power source ELVDD and the second transistor M2' are electrically blocked. When the seventh transistor M7 is turned off, the second power source ELVSS and the second transistor M2' are electrically blocked.

When the first control signal is supplied to the first control line CL1, the fourth transistor M4' is turned on. When the fourth transistor M4' is turned on, the voltage of the initial power source Vint is supplied to the second node N2.

After the voltage of the initial power source Vint is supplied to the second node N2, the second control signal is supplied to the second control line CL2 so that the third transistor M3' and the fifth transistor M5 are turned on. When the third transistor M3' is turned on, the voltage corresponding to the left data signal LD charged in the first capacitor C1 in the (i−1)th frame i−1F is supplied to the first electrode of the second transistor M2'.

At this time, since the second node N2 is initialized to the voltage of the initial power source Vint lower than the data signals, the second transistor M2' coupled in the form of a diode is turned on. When the second transistor M2' is turned on, the voltage obtained by subtracting the threshold voltage of the second transistor M2' from the voltage applied to the first electrode of the second transistor M2' is supplied to the second node N2. At this time, the second capacitor C2' charges the voltage corresponding to the voltage applied to the second node N2. The second capacitor C2' charges the voltages corresponding to the left data signal LD supplied in the (i−1)th frame i−1F and the threshold voltage of the second transistor M2'.

After the voltages are charged in the second capacitor C2', the supply of the emission control signal to the emission control line E is stopped. For example, the supply of the emission control signal to the emission control line E is stopped before a scan signal is supplied to the first scan line S1. When the supply of the emission control signal to the emission control line E is stopped, the sixth transistor M6 and the seventh transistor M7 are turned on.

When the sixth transistor M6 is turned on, the first power source ELVDD and the first electrode of the second transistor M2' are electrically coupled to each other. When the seventh transistor M7 is turned on, the second electrode of the second transistor M2' and the anode electrode of the OLED are electrically coupled to each other. At this time, the second transistor M2' controls the amount of current that flows from the first power source ELVDD to the second power source ELVSS via the OLED to correspond to the voltage applied to the second node N2. That is, in the ith frame iF, the pixels 142 emit light to correspond to the left data signal LD supplied in the (i−1)th frame i−1F.

The scan signals are sequentially supplied to the first scan line S1 to the nth scan line Sn. Then, the right data signals RD are supplied to the data lines D1 to Dm in synchronization with the scan signals. When the scan signals are sequentially supplied to the scan lines S1 to Sn, the first transistors M1 included in the pixels 146 in units of horizontal lines are turned on. At this time, the right data signals RD from the data lines D1 to Dm are supplied to the first nodes N1 via the first transistors M1. Then, the voltages corresponding to the right data signals RD are charged in the first capacitors C1 included in the pixels 146.

In the (i+1)th frame i+1F, the first control signal and the second control signal are sequentially supplied to the first control line CL1 and the second control line CL2. Then, the emission control signal is supplied to the emission control line E to overlap the first control signal and the second control signal.

When the emission control signal is supplied to the emission control line E, the sixth transistor M6 and the seventh transistor M7 are turned off. When the first control signal is supplied to the first control line CL1, the fourth transistor M4' is turned on so that the voltage of the initial power source Vint is supplied to the second node N2.

After the voltage of the initial power source Vint is supplied to the second node N2, the second control signal is supplied to the second control line CL2 so that the third transistor M3' and the fifth transistor M5 are turned on. When the third transistor M3' and the fifth transistor M5 are turned on, the voltage obtained by subtracting the threshold voltage of the second transistor M2' from the voltage applied to the first electrode of the second transistor M2' is supplied to the second node N2. At this time, the second capacitor C2' charges the voltages corresponding to the right data signal RD supplied in the ith frame iF and the threshold voltage of the second transistor M2'.

After the voltages of the second capacitor C2' are charged, the supply of the emission control signal to the emission control line E is stopped so that the sixth transistor M6 and the seventh transistor M7 are turned on. When the sixth transistor M6 is turned on, the first power source ELVDD and the first electrode of the second transistor M2' are electrically coupled to each other. When the seventh transistor M7 is turned on, the second electrode of the second transistor M2' and the anode electrode of the OLED are electrically coupled to each other. At this time, the second transistor M2 controls the amount of current that flows from the first power source ELVDD to the second power source ELVSS via the OLED to correspond to the voltage applied to the second node N2. In the (i+1)th frame i+1F, the pixels 142 emit light to correspond to the right data signals RD supplied in the ith frame iF.

The scan signals are sequentially supplied to the first scan line S1 to the nth scan line Sn. The left data signals LD are supplied to the data lines D1 to Dm in synchronization with the scan signals. When the scan signals are sequentially supplied to the scan lines S1 to Sn, the first transistors M1 included in the pixels 146 in units of horizontal lines are turned on. At this time, the left data signals LD from the data lines D1 to Dm are supplied to the first nodes N1 through the first transistors M1. Then, the first capacitor C1 included in the pixels 146 charge the voltages corresponding to the left data signals LD.

By way of summation and review, shutter glasses receive light from a left glass in the first frame among four frames and receive light from a right glass in the third frame. At this time, the person who wears the shutter glasses recognizes the 3D image supplied through the shutter glasses. The black image displayed in the second frame and the fourth frame prevents a left image and a right image from being mixed with each other. If the left image and the right image are mixed, crosstalk may be generated.

In order to have the four frames included in the period of 16.6 ms, the organic light emitting display must be driven at the driving frequency of 240 Hz. When the organic light emitting display is driven at a high frequency, power consumption increases, stability deteriorates, and manufacturing cost increases.

Circumventing such situations, present embodiments are directed to a pixel capable of being driven at a low driving frequency, and an organic light emitting display using the same.

In the pixel according to present embodiments and the organic light emitting display using the same, the pixels emit light and the data signals may be simultaneously charged so that the organic light emitting display may realize the 3D image while being driven at the low driving frequency.

Example embodiments have been disclosed herein, and although specific terms are employed, they are used and are to be interpreted in a generic and descriptive sense only and not for purpose of limitation.

What is claimed is:

1. A pixel, comprising:

an organic light emitting diode (OLED) with a first electrode coupled to a second power source;

a first transistor with a first electrode coupled to a data line, and with a second electrode coupled to a first node, the first transistor being turned on when a scan signal is supplied to a scan line;

a first capacitor coupled between the first node and a third power source, the first capacitor to charge a first capacitor voltage corresponding to a data signal supplied from the data line; and a pixel circuit including:

a second capacitor coupled between a second node and a first power source, the second capacitor to charge a second capacitor voltage according to the first capacitor voltage charged in the first capacitor;

a second transistor to drive the OLED to flow current corresponding to the second capacitor voltage charged in the second capacitor through the OLED, the second transistor coupled between the first power source and a second electrode of the OLED and having a gate electrode connected to the second node; and a third transistor coupled between the first node and the second node, wherein when the first capacitor voltage corresponding to the data signal is charged in the first capacitor, the first transistor is turned on such that the data line is electrically connected to the first node and the third transistor is turned off such that the second node is electrically disconnected from the first node.

2. The pixel as claimed in claim 1, wherein the third power source is set to have the same voltage as the first power source voltage.

3. The pixel as claimed in claim 1, wherein the third power source is coupled to the first capacitor through a line separate from the first power source.

4. The pixel as claimed in claim 1, wherein the third power source supplies a direct current voltage.

5. The pixel as claimed in claim 1, wherein the third power source is set as one voltage of a plurality of voltages supplied to the pixel circuit.

6. The pixel as claimed in claim 5, wherein the third power source is the first power source.

7. The pixel as claimed in claim 1, wherein the pixel circuit further includes a fourth transistor coupled between the gate electrode of the second transistor and an initial power source and turned on before the third transistor is turned on in the frame, wherein the third transistor is turned on before the first transistor is turned on in a frame.

8. The pixel as claimed in claim 7, wherein the third power source is the initial power source.

9. The pixel as claimed in claim 1, wherein when the second capacitor charges the second capacitor voltage according to the first capacitor voltage charged in the first capacitor, the first node is electrically disconnected from the data line.

10. The pixel as claimed in claim 1, wherein a voltage level of the second power source is different from that of the third power source.

11. An organic light emitting display, comprising:

pixels positioned at intersections of scan lines and data lines;

a scan driver for sequentially supplying scan signals to the scan lines;

a data driver for supplying data signals to the data lines in synchronization with the scan signals;

a first control line and a second control line coupled to the respective pixels; and a control driver for sequentially supplying a first control signal to the first control line and a second control signal to the second control line in a stage before the scan signals are supplied to the scan lines in frames, wherein, among the pixels, a pixel positioned in a jth horizontal line includes:

an OLED with a first electrode coupled to a second power source;

a first transistor coupled between at least one of the data lines and a first node, the first transistor being turned on to electrically connect between the at least one of the data lines and the first node when at least one of the scan signals is supplied to the jth scan line;

a first capacitor coupled between the first node and a third power source, the first capacitor for charging a data signal voltage corresponding to at least one of the data signals when, among the scan signals, a scan signal is supplied to a jth scan line;

a second capacitor coupled between a second node and a first power source, the second capacitor for charging a first capacitor voltage corresponding to the voltage charged in the first capacitor when the second control signal is supplied to the second control line;

a second transistor to drive the OLED to flow current corresponding to the second capacitor voltage charged in the second capacitor through the OLED, the second transistor coupled between the first power source and a second electrode of the OLED and having a gate electrode connected to the second node; and a third transistor coupled between the first node and the second node, and wherein when the first capacitor voltage corresponding to the data signal is charged in the first capacitor, the first transistor is turned on such that the at least one of the data lines is electrically connected to the first node and the third transistor is turned off such that the second node is electrically disconnected from the first node.

12. The organic light emitting display as claimed in claim 11, wherein the data driver alternately supplies left data signals and right data signals to the data lines each of the frames.

13. The organic light emitting display as claimed in claim 11, wherein the first capacitor has a higher capacitance than the second capacitor.

14. The organic light emitting display as claimed in claim 11, wherein the third power source is set to have a same voltage as the first power source.

15. The organic light emitting display as claimed in claim 11, wherein the third power source is coupled to the first capacitor through a line separate from the first power source.

16. The organic light emitting display as claimed in claim 11, wherein the third power source supplies a direct current voltage.

17. The organic light emitting display as claimed in claim 11, wherein the third power source is set as one voltage of a plurality of voltages supplied to the pixel positioned in the jth horizontal line.

18. The organic light emitting display as claimed in claim 17, wherein the third power source is the first power source.

19. The organic light emitting display as claimed in claim 11, wherein the pixel positioned in the jth horizontal line further includes a fourth transistor coupled between the gate electrode of the second transistor and an initial power source and turned on when the first control signal is supplied.

* * * * *